US009453436B2

(12) United States Patent
Graham

(10) Patent No.: US 9,453,436 B2
(45) Date of Patent: Sep. 27, 2016

(54) OVERHEAD CAMSHAFT INTERNAL COMBUSTION ENGINE WITH HIGH-PRESSURE FUEL INJECTION SYSTEM

(71) Applicant: DELPHI INTERNATIONAL OPERATIONS LUXEMBOURG, S.A.R.L., Bascharage (LU)

(72) Inventor: Mark S. Graham, Westbury-On-Trym (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 141 days.

(21) Appl. No.: 14/403,216

(22) PCT Filed: May 9, 2013

(86) PCT No.: PCT/EP2013/059689

§ 371 (c)(1),
(2) Date: Nov. 24, 2014

(87) PCT Pub. No.: WO2013/174660

PCT Pub. Date: Nov. 28, 2013

(65) Prior Publication Data

US 2015/0096537 A1 Apr. 9, 2015

(30) Foreign Application Priority Data

May 24, 2012 (GB) ..... 1209108.8

(51) Int. Cl.
*F01L 1/053* (2006.01)
*F02M 59/02* (2006.01)

(Continued)

(52) U.S. Cl.
CPC ..... *F01L 1/0532* (2013.01); *F01L 1/047* (2013.01); *F01L 1/053* (2013.01); *F01L 1/08* (2013.01);

(Continued)

(58) Field of Classification Search
CPC ..... F01L 1/0532; F01L 1/08; F01L 1/047; F01L 1/053; F01L 1/18; F02M 63/0275; F02M 59/102; F02M 39/00; F02M 39/02; F02M 37/06; F02M 59/027; F02B 75/20
USPC ..... 123/456, 508, 509, 90.17
See application file for complete search history.

(56) References Cited

U.S. PATENT DOCUMENTS 5,083,545 A * 1/1992 Yamashita ..... F02B 67/00 123/195 R
5,603,303 A 2/1997 Okajima et al.

(Continued)

FOREIGN PATENT DOCUMENTS

DE 10 2005 012928 A1 9/2006
DE 10 2007 029416 A1 1/2009

(Continued)

OTHER PUBLICATIONS

International Search Report dated Sep. 11, 2013.

*Primary Examiner* — Grant Moubry
(74) *Attorney, Agent, or Firm* — Patrick M. Griffin

(57) ABSTRACT

An overhead-camshaft internal combustion engine is disclosed, in which the fuel pumps are arranged to use efficiently the space within a cylinder head assembly of the engine. The cylinder head assembly includes a cylinder head block, and the engine comprises a camshaft rotatable about a camshaft axis and having a plurality of inlet and exhaust cams for actuating associated inlet and exhaust valves of the engine, and at least one fuel pump comprising a unit pump assembly driven directly by a respective pump cam provided on the camshaft. The engine further comprises a plurality of rocker arms driven by the inlet and exhaust cams and arranged to actuate the inlet and exhaust valves. Each rocker arm is pivotable about a rocker arm axis which is substantially parallel to the camshaft axis. The or each pump assembly is mounted between the rocker arm axis and the cylinder head block.

14 Claims, 5 Drawing Sheets

(51) Int. Cl.

| | |
|---|---|
| ***F02M 39/00*** | (2006.01) |
| ***F01L 1/047*** | (2006.01) |
| ***F01L 1/08*** | (2006.01) |
| ***F02M 63/02*** | (2006.01) |
| *F02M 59/10* | (2006.01) |
| *F01L 1/18* | (2006.01) |
| *F02B 75/20* | (2006.01) |

(52) U.S. Cl.
CPC ..... *F02M 39/00* (2013.01); *F02M 59/027* (2013.01); *F02M 63/0275* (2013.01); *F01L 1/18* (2013.01); *F02B 75/20* (2013.01); *F02M 59/102* (2013.01)

(56) References Cited

U.S. PATENT DOCUMENTS

| | | | | |
|---|---|---|---|---|
| 5,605,077 A | 2/1997 | Tsunoda et al. | | |
| 5,809,952 A * | 9/1998 | Ono | F01L 1/181 | 123/182.1 |
| 6,247,450 B1 * | 6/2001 | Jiang | F02M 57/023 | 123/446 |
| 6,354,278 B1 | 3/2002 | Kawasaki | | |
| 7,588,016 B2 | 9/2009 | Pauer | | |
| 2002/0072281 A1 | 6/2002 | Takahashi | | |
| 2008/0184962 A1 | 8/2008 | Pauer | | |

FOREIGN PATENT DOCUMENTS

| | | | |
|---|---|---|---|
| JP | DE 3447912 A1 * | 7/1985 | F01P 3/202 |
| JP | H074214 | 1/1995 | |
| JP | H0814140 | 1/1996 | |
| JP | H08261001 | 10/1996 | |
| JP | 2000297718 | 10/2000 | |
| JP | 2008533387 | 8/2008 | |
| JP | 2008215301 | 9/2008 | |
| WO | 94/12787 A1 | 6/1994 | |

* cited by examiner

OVERHEAD CAMSHAFT INTERNAL COMBUSTION ENGINE WITH HIGH-PRESSURE FUEL INJECTION SYSTEM

CROSS REFERENCE TO RELATED APPLICATIONS

This application is a national stage application under 35 U.S.C. 371 of PCT Application No. PCT/EP2013/059689 having an international filing date of 9 May 2013, which designated the United States, which PCT application claimed the benefit of Great Britain Patent Application No. 1209108.8 filed on 24 May 2012, the entire disclosure of each of which are hereby incorporated herein by reference.

FIELD OF THE INVENTION

The present invention relates to an internal combustion engine having a high-pressure fuel injection system. In particular, but not exclusively, the invention relates to an arrangement of one or more fuel pumps in an overhead-camshaft combustion ignition engine.

BACKGROUND TO THE INVENTION

In fuel injection systems for use in internal combustion engines, it is known to provide one or more fuel pumps to supply pressurised fuel to the fuel injectors of the engine. The fuel injectors are mounted in a cylinder head assembly of the engine, alongside inlet and exhaust gas valves. The cylinder head assembly is mounted to a cylinder block of the engine, in which the engine cylinders are formed, so that the tips of the injectors and the inlet and exhaust valves are exposed to the respective combustion spaces defined by the cylinders.

The inlet and exhaust valves are operated by one or more main camshafts, which are mounted either in the cylinder head assembly in an overhead camshaft engine, or in or on the engine block in a cam-in-block engine. In typical cam-in-block engines, push-rods cooperate with associated cams on the camshaft to transfer drive from the camshaft to pivoting rocker arms in the cylinder head assembly, which in turn actuate the respective gas valves. In overhead camshaft engines, push rods are not required and instead the rocker arms can be driven directly by the cams.

A high-pressure fuel pump generally includes a plunger that is driven for reciprocal movement within a bore provided in the pump housing by means of a cam drive arrangement. Typically, the cam drive arrangement includes a cam and a cam follower (such as a roller). The cam follower cooperates directly or indirectly with an engine-driven cam, so as to drive a pumping stroke of the plunger during which fuel is pressurised. In a high-pressure medium- or heavy-duty engine, several fuel pumps are often used to supply the necessary pressure and volume of fuel. The components of each pump may be mounted in a modular pump housing.

The fuel pumps must be positioned in the engine in a location where a suitable engine-driven cam can be provided to drive the pump. Furthermore, to minimise the cost and complexity of the fuel injection system, it is desirable that the fuel pumps are mounted relatively close to the fuel injectors. Accordingly, several ways of arranging the fuel pumps have been developed.

In one known fuel injection system, each of the injectors has an integrated pump assembly, mounted in line with the electronically-controlled injector. Such injectors are typically known as unit injectors. In these systems, it is necessary to drive the fuel pumps along a direction coaxial with the cylinder head bores in which the fuel injectors are mounted. In an overhead camshaft engine, the pumps may be driven using a rocker-arm arrangement in which additional cams are mounted on the main camshaft. Alternatively, the pumps of the unit injectors can be driven by a push-rod arrangement in a cam-in-block engine.

FIG. 1 of the accompanying drawings illustrates a known arrangement of this type in an overhead camshaft engine. FIG. 1 is a view of parts of the cylinder head assembly, viewed from above, with the rocker cover removed. The camshaft 10, which is driven by a timing wheel 12 connected to the crankshaft 10 with a belt or chain (not shown), extends horizontally or longitudinally along the cylinder head assembly. The camshaft is held in place by a plurality of journal bearings, which are housed in bearing caps or housings 14. The bearing housings are mounted to a cylinder head block (not shown) by way of bolts 16.

The camshaft 10 carries a plurality of cams (not shown), each of which actuates an associated rocker arm 18*a*, 18*b*, 18*c*. The rocker arms are pivotable about a rocker arm shaft 20, which extends parallel to the camshaft 10. Three rocker arms are provided for each cylinder of the engine: an inlet valve rocker arm 18*a* actuates the inlet valves 22*a* of the cylinder; an outlet valve rocker arm 18*b* actuates the outlet valves 22*b* of the cylinder; and an injector rocker arm 18*c* actuates the pump mechanism of a unit injector 24 mounted vertically in the cylinder head block. Each group of three rocker arms 18*a*, 18*b*, 18*c* is separated from the group of three rocker arms associated with an adjacent cylinder by one of the bearing housings 14, so that the bearing housings 14 are equally spaced along the camshaft 10 and are aligned with the gaps between adjacent cylinders of the engine.

When unit injectors are used, fuel that is pressurised within each unit injector may be used exclusively in that injector, as is the case in the arrangement shown in FIG. 1. Alternatively, each unit injector may be connected to an accumulator rail or common rail, which serves as a reservoir for high-pressure fuel for all of the injectors. In such an arrangement, a combination of unit injectors (with integrated pumps) and non-pumping injectors (which receive high-pressure fuel only from the common rail) may be used to reduce the cost and complexity of the system.

FIG. 2 of the accompanying drawings, which is similar to FIG. 1 and in which like reference numerals are used for like parts, illustrates a common-rail system in which unit injectors with integral pump mechanisms 24 are used in combination with non-pumping injectors 26. Each of the injectors 24, 26 is connected by high-pressure fuel pipes 28 to a common accumulator rail 30, which in this example extends parallel to the camshaft 10. Advantageously, the cost and complexity of this system is reduced compared to the FIG. 1 arrangement, since fewer moving parts are required.

Advantageously, the arrangements shown in FIGS. 1 and 2 are relatively compact, and in particular the distance through which the high pressure fuel supplied by the pumps must be conveyed to reach the injectors is relatively short. Also, the fuel injection components can all be accommodated in the cylinder head assembly, and covered by the rocker cover of the engine to damp the noise from the pumps. However, the use of rocker arms to drive the pumping mechanisms of the pumps can result in undesirable side-loads on the pumping mechanism. Furthermore, the rocker arms that drive the pumps are usually heavy, to ensure durability and stiffness, and so the pumps must be equipped with a high-force return spring to ensure that the cam follower of each pump remains in contact with its associated rocker arm at all engine speeds.

Further disadvantages can arise from the integration of the pump components with the fuel injection components. In particular, in integrated unit injectors, the space available for the fuel injector components is restricted and the injector components are subjected to the undesirable cyclic loads that are generated in the pumping mechanism.

Another known system, which avoids some of the above-described problems with unit injector systems, employs linear-type unit pumps that are separate from the injectors. Each unit pump may be linked to a respective injector, or all of the unit pumps may be linked to a common fuel rail from which the injectors are supplied. As will be appreciated from FIGS. 1 and 2, due to space constraints in the cylinder head assembly, it is not generally possible to mount such stand-alone (i.e. non-injecting) unit pumps in the cylinder head.

Another known system is known from U.S. Pat. No. 6,354,278 disclosing an engine for an outboard motor wherein a fuel pump is mounted laterally to the engine block.

Accordingly, the unit pumps are typically mounted within or on the engine block, and are driven from a drive shaft mounted in or on the block. Unit pump systems are therefore best suited for cam-in-block engines, in which the unit pumps can be driven from the block-mounted gas valve camshaft. If it is desired to use a unit pump arrangement in an overhead camshaft engine, it is necessary to provide a dedicated fuel pump driveshaft in or on the block, adding considerably to the cost and complexity of the system. Furthermore, because the pumps are mounted in or on the engine block, noise and vibration from the pumps can be transmitted directly into the engine bay, and the high-pressure fuel pipes that convey the fuel from the pumps to the injectors need to be relatively long and routed externally to the engine.

Another arrangement utilises a remote fuel pump, such as a radial fuel pump, which is mounted remotely from the injectors and is connected to a common rail by a suitable high-pressure fuel line. The remote pump is typically mounted outside the engine block, and is driven by a drive gear arrangement linked to the engine crankshaft. In such systems, it is necessary to add an auxiliary drive wheel to the engine to drive the gear arrangement for the pump, and the remote pump itself must include its own camshaft, bearings, cam housing, and lubrication system for the drive mechanism.

Against this background, it would be desirable to provide an arrangement of fuel pumps for a fuel injection system of an internal combustion engine in which the cost and complexity of the system is minimised and in which the above-mentioned problems with known arrangements are reduced or mitigated.

SUMMARY OF THE INVENTION

From a first aspect, the present invention resides in an overhead-camshaft internal combustion engine having a cylinder head assembly including a cylinder head block. The engine comprises a camshaft mounted longitudinally with respect to the cylinder head assembly, the camshaft being rotatable about a camshaft axis and having a plurality of inlet and exhaust cams for actuating associated inlet and exhaust valves of the engine; and at least one fuel pump comprising a unit pump assembly driven directly by a respective pump cam provided on the camshaft. The unit pump assembly is elongate to define a pump axis. The engine further comprises a plurality of rocker arms driven by the inlet and exhaust cams and arranged to actuate the inlet and exhaust valves. Each rocker arm is pivotable about a rocker arm axis which is substantially parallel to the camshaft axis, and the or each unit pump assembly is mounted between the rocker arm axis and the cylinder head block.

With this arrangement, the or each unit pump assembly advantageously can be arranged substantially transversely across the cylinder head assembly, across the cylinder head block and beneath the rocker arm axis. In this way, the present invention provides a way of accommodating unit pump assemblies in a compact and space efficient way, without needing also to integrate the pump components with the fuel injectors. The unit pump assemblies are accommodated beneath the rocker arm shaft about which the rocker arms pivot, making very efficient use of the space available in the cylinder head assembly. Accordingly, the disadvantages of having separate, non-injecting pumps mounted on or in the engine block are avoided.

Furthermore, because the or each unit pump assembly is driven directly from the main engine camshaft, it is not necessary to provide a dedicated drive mechanism for each pump. Therefore the cost and complexity of the system is reduced compared to known arrangements.

The cylinder head block may include one or more bores for receiving one or more respective fuel injectors of the engine. The fuel injectors are separate from the or each unit pump assembly, and are preferably connected to the or each unit pump assembly by way of high-pressure fuel lines.

The or each unit pump assembly may be mounted such that its respective pump axis is substantially perpendicular to the camshaft axis and extends laterally with respect to the cylinder head assembly.

The or each pump axis is preferably disposed intermediate the rocker arm axis and the cylinder head block. Said another way, the rocker arm axis may be spaced from the cylinder head block to define a space therebetween, and the or each pump axis may extend, at least in part, into or through the space.

In one example, the or each unit pump assembly may be mounted in a sleeve, and the or each rocker arm may be mounted on a rocker shaft which is, in turn, mounted on the sleeve. Alternatively, the or each rocker arm may be mounted on a rocker shaft that is mounted directly to the cylinder head block.

The cylinder head block may comprise a mating surface for mating with an engine block of the engine, and the or each unit pump assembly may be mounted such that its respective pump axis is substantially parallel to the mating surface.

The engine typically comprises a plurality of engine cylinders, and the or each unit pump assembly is preferably aligned with a gap between two adjacent cylinders. In this way, the fuel injectors and gas valves associated with each cylinder are not hindered by the unit pump assemblies.

A plurality of bearings for supporting the camshaft may be provided. In one embodiment, at least one of the bearings may be aligned centrally with respect to a respective one of the cylinders. In other words, at least one of the bearings may be aligned with a mid-point of a respective cylinder. Furthermore, at least one of the bearings may be aligned with a gap between two adjacent cylinders. Advantageously, the bearings may be unequally spaced along the length of the camshaft. In this way, spaces can be created along the camshaft to accommodate one or more unit pump assemblies.

The or each unit pump assembly may comprise a cam follower arrangement that cooperates with the associated pump cam, thereby to transmit drive from the pump cam to the unit pump assembly. The cam follower arrangement may comprise a roller tappet, which minimises wear and is therefore particularly suitable for use at very high pumping pressures.

The or each unit pump assembly may be connected to a high-pressure common fuel rail. Conveniently, the common rail may be mounted longitudinally with respect to the cylinder head assembly, to provide a space-efficient configuration. Alternatively, a common rail may be omitted, and the or each unit pump assembly may be connected directly to an associated fuel injector. When a plurality of fuel injectors is present, each fuel injector may be connected directly to at least one other fuel injector. For example, the fuel injectors and the or each fuel pump can be connected together in series.

In another aspect of the invention, an overhead-camshaft internal combustion engine having a cylinder head assembly is provided. The cylinder head assembly includes a cylinder head block, and the engine comprises a camshaft mounted longitudinally with respect to the cylinder head assembly, the camshaft being rotatable about a camshaft axis and having a plurality of inlet and exhaust cams for actuating associated inlet and exhaust valves of the engine, and at least one fuel pump comprising a unit pump assembly driven directly by a respective pump cam provided on the camshaft. The unit pump assembly is elongate to define a pump axis, and the or each unit pump assembly is mounted such that its respective pump axis is substantially perpendicular to the camshaft axis and extends laterally with respect to the cylinder head assembly.

In a further aspect of the invention, an overhead-camshaft internal combustion engine having a cylinder head assembly is provided. The engine comprises a camshaft mounted longitudinally with respect to the cylinder head assembly, the camshaft being rotatable about a camshaft axis and having a plurality of inlet and exhaust cams for actuating associated inlet and exhaust valves of the engine, and at least one fuel pump comprising a unit pump assembly driven directly by a respective pump cam provided on the camshaft. The engine further comprises a plurality of bearings for supporting the camshaft. The bearings are unequally spaced along the length of the camshaft to accommodate the or each unit pump assembly.

In a still further aspect of the invention, an overhead-camshaft internal combustion engine having a cylinder head assembly is provided. The engine comprises a camshaft mounted longitudinally with respect to the cylinder head assembly, the camshaft being rotatable about a camshaft axis and having a plurality of inlet and exhaust cams for actuating associated inlet and exhaust valves of the engine, and at least one fuel pump comprising a unit pump assembly driven directly by a respective pump cam provided on the camshaft. The engine comprises a plurality of engine cylinders, and the or each unit pump assembly is aligned with a gap between two adjacent cylinders.

Preferred and/or optional features of the first aspect of the invention may be used, alone or in appropriate combination, with the other aspects of the invention also.

BRIEF DESCRIPTION OF THE DRAWINGS

Embodiments of the present invention will now be described, by way of example only, with reference to the remaining accompanying drawings, in which like reference numerals are used for like parts, and in which.

Throughout this description, terms such as upper, lower, horizontal, vertical and so on are used with reference to the orientation of the parts in the accompanying drawings. It will be appreciated that the parts could be arranged in other orientations in use.

DETAILED DESCRIPTION OF EMBODIMENTS OF THE INVENTION

Figure 3:
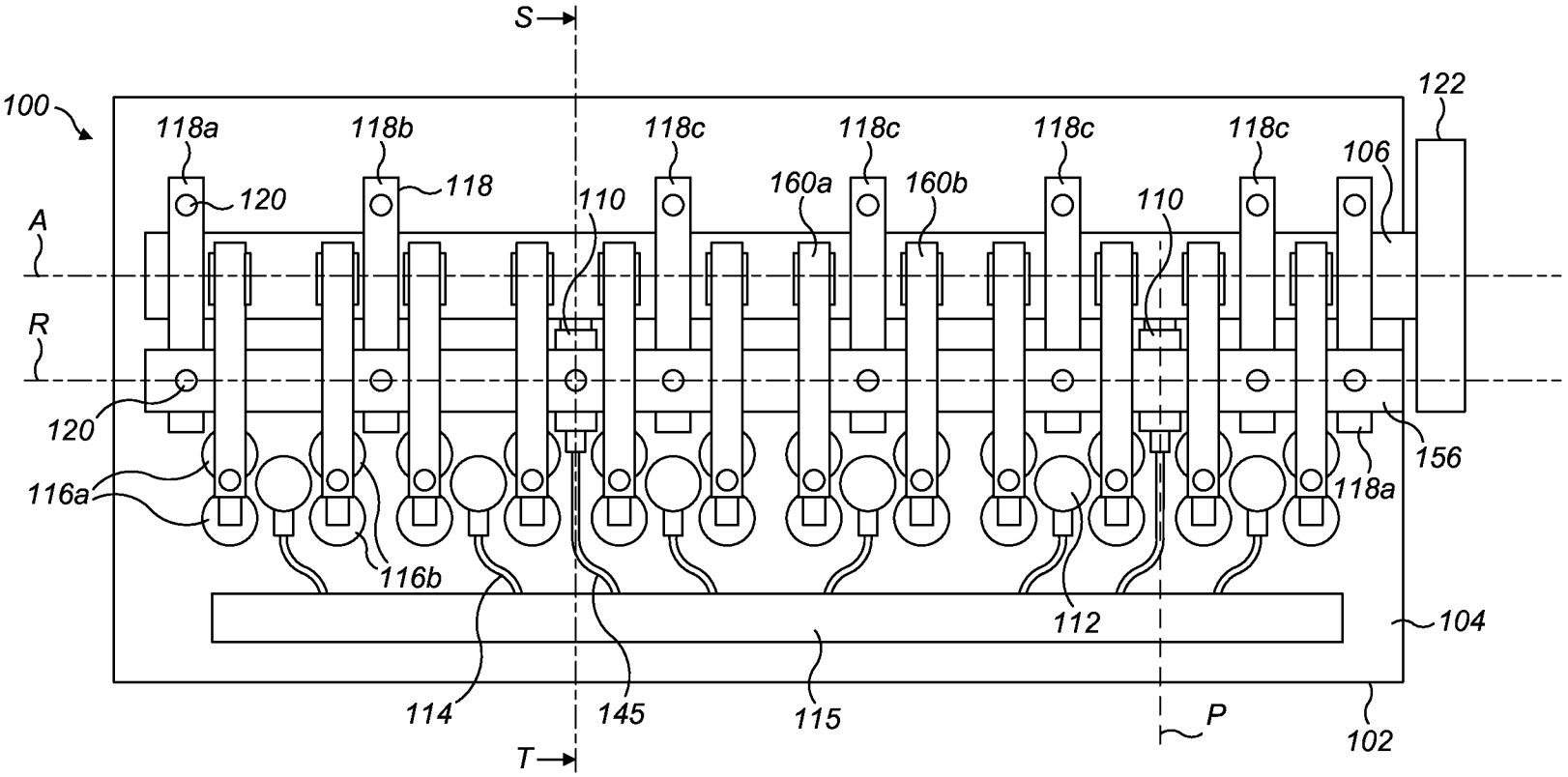
FIG. 3 is a schematic plan view of a cylinder head assembly in a first embodiment of an engine according to the present invention, showing an arrangement of fuel pumps.
Figure 4:
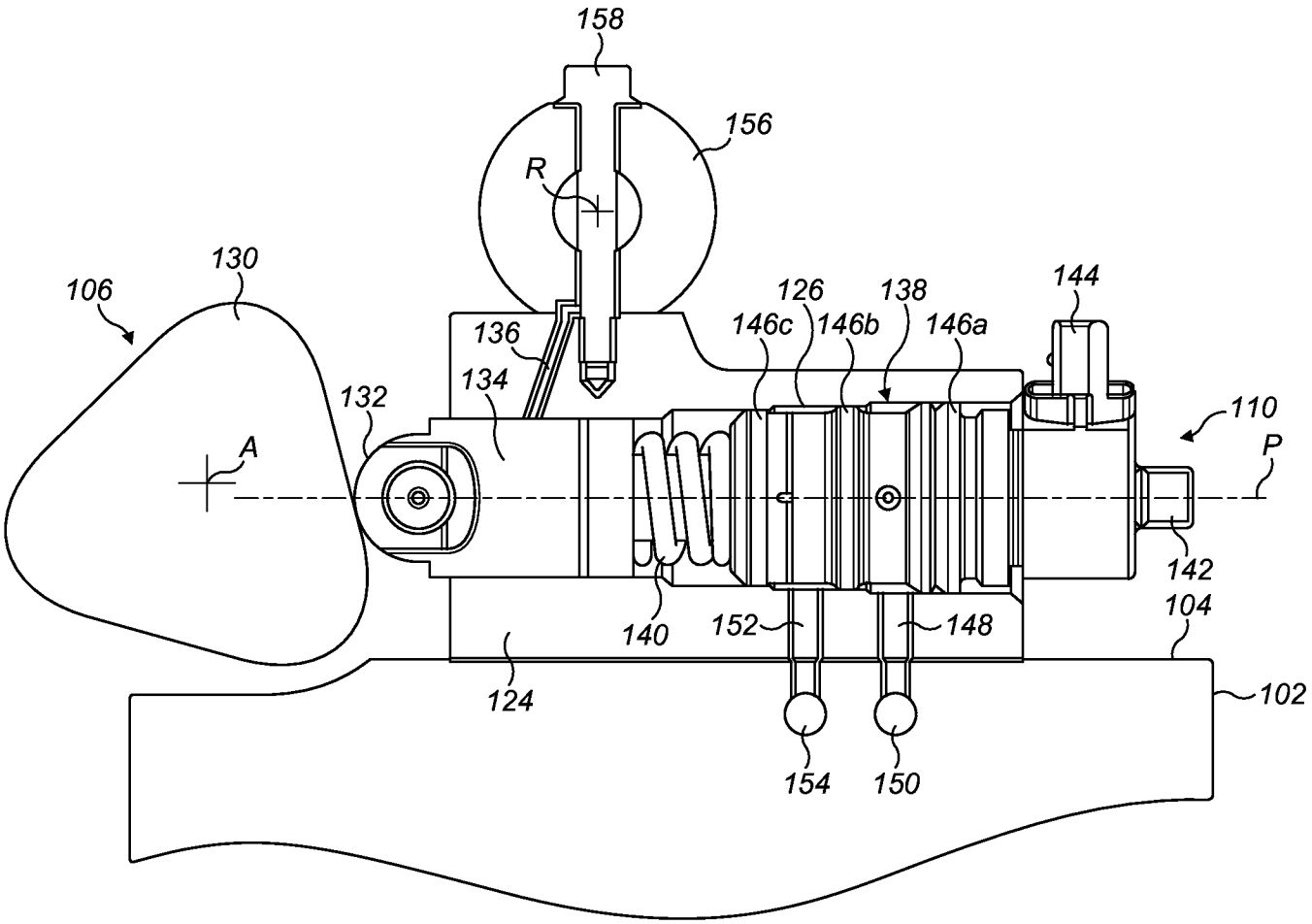
FIG. 4 is a partial cross-sectional view of part of the engine of FIG. 3, taken on a vertical plane.

Referring first to FIGS. 3 and 4, an overhead-camshaft internal combustion engine according to one embodiment of the present invention comprises a cylinder head assembly 100 that houses a plurality of linear-type unit pumps 110 for pressurising fuel in a fuel injection system of the engine. FIG. 3 is a schematic plan view of the cylinder head assembly 100, and FIG. 4 is a partial cross-sectional view of the cylinder head assembly 100, taken on a vertical plane marked S-T in FIG. 3. For clarity, only the relevant components of the engine are shown in FIGS. 3 and 4.

The cylinder head assembly 100 comprises a cylinder head block 102 which is mounted to an engine block (not shown) in which the combustion cylinders of the engine are formed. The illustrated embodiment is of an in-line six-cylinder engine. A lower face (not shown) of the cylinder head block 102 forms a mating surface for mating with the engine block. An opposite and parallel upper face of the cylinder head block 102 forms a mounting surface 104. In the plane of the mounting surface 104, the cylinder head block 102 has a relatively long longitudinal dimension along which the cylinders of the engine are arranged, and a relatively short lateral or transverse dimension which is perpendicular to the longitudinal direction.

A plurality of fuel injectors 112, visible in FIG. 3 and not shown in FIG. 4, are mounted in bores (not shown) that extend approximately vertically through the cylinder head block 102. A tip or nozzle of each injector 112 protrudes downwardly through the mating face of the cylinder head block 102 and into a respective cylinder of the engine. The upper ends of the injectors 112 protrude from the mounting surface 104, and each injector 112 is connected at its upper end with a corresponding electrical connector (not shown) and a corresponding high-pressure fuel line 114. The fuel lines 114 are connected, in turn, to an accumulator volume in the form of a common rail 115, which extends longitudinally with respect to the cylinder head assembly 100 and is mounted to the cylinder head block 102.

Inlet and exhaust gas valves 116*a*, 116*b* of the poppet-valve type are arranged around each injector 112. In the example illustrated in FIG. 3, two inlet valves 116*a* and two exhaust valves 116*b* are provided for each cylinder of the engine, and the four valves 116*a*, 116*b* are arranged in a generally square configuration with the injector at the centre of the square. A lower end of each valve is engageable with an associated seating provided on the mounting face of the cylinder head block 102, and a stem of each valve 116*a*, 116*b* extends upwardly through a respective bore in the cylinder head block 102 and emerges from the mounting surface 104.

The camshaft 106 is rotatably mounted in a plurality of journal bearings, which are in turn mounted in bearing caps or housings 118. The bearing housings 118 are attached to the mounting surface 104 of the cylinder head block 102 by way of vertically-extending bolts 120. The camshaft 106 is driven by a timing wheel 122, which is driven by the engine crankshaft by a timing belt or chain (not shown). The camshaft is therefore driven in rotation when the engine is in use. The camshaft rotates around a camshaft axis A, which lies longitudinally with respect to the cylinder head block 102 and parallel to the mounting surface 104. In other words, the camshaft is arranged parallel to the long edges of the cylinder head block 102.

In the illustrated embodiment, two fuel pumps 110 are provided. As shown most clearly in FIG. 4, the fuel pumps 110 are of the unit pump type, and are elongate to define a pump axis P. The pumps 110 are mounted so that the pump axis P is perpendicular to the camshaft axis A, and so that the pump axis P extends laterally with respect to the cylinder head assembly 100. In other words, the pump axis P lies transversely or horizontally across the top of the cylinder head block 102, approximately parallel to the mounting surface 104 and to the mating face between the cylinder head block 102 and the engine block.

Each pump 110 is mounted in a pump sleeve 124, which is generally cuboidal, and which has a central bore 126 coaxial with the pump axis P. Each pump 110 is mounted in the bore 126 of a respective sleeve 124, such that a first end of the pump 110, which is provided with a cam follower 128, is held in position against a respective pump cam 130 provided on the camshaft 106. In the illustrated embodiment, the pump cams 130 are three-lobed cams.

The cam follower 128 comprises a roller 132 that rides on the pump cam 130, and a roller shoe 134 that retains the roller. The roller shoe 134 is slidably engaged with the sleeve bore 126. An oilway 136 provides lubricating fluid to the sleeve bore 126 to lubricate the sliding movement of the shoe 134 within the bore 126.

As in known unit pumps, the cam follower 128 drives a pumping plunger (not shown) of the pump to compress fuel in a pump chamber (not shown) in a main body portion 138 of the pump 110. A return spring 140 keeps the roller 132 in engagement with the pump cam 140.

A second end of each pump 110, opposite the first end and furthest from the camshaft 106, protrudes from the sleeve 124 and provides an outlet 142 for high-pressure fuel and an electrical connector 144 for the pump 110. The outlet 142 of each pump is connected to the common rail 115 by way of an associated high-pressure fuel line 145.

Referring again to FIG. 4, the main body 138 of each pump 110 is sealed in the sleeve bore 126 by means of three o-ring seals 146*a*, 146*b*, 146*c*, which are spaced apart along the pump axis to define two annular chambers between each pair of seals. A low-pressure fuel feed passage 148 extends through the sleeve 124 to open into the annular chamber formed between the first seal 146*a*, closest to the second end of the pump, and the intermediate second seal 146*b*. The fuel feed passage 148 connects with a low-pressure fuel supply gallery 150 provided in the cylinder head block 102, which allows fuel to flow into the pump from a fuel tank.

Similarly, a fuel return passage 152 extends through the sleeve 124 to open into the annular chamber formed between the second seal 146*b* and the third seal 146*c*, closest to the first (camshaft) end of the pump. The fuel return passage 152 connects with a fuel return gallery 154 provided in the cylinder head block 102, to allow unused fuel from the pump 110 to flow back to the fuel tank.

Referring back to FIG. 3, a generally cylindrical rocker shaft 156 is positioned longitudinally across the cylinder head assembly 100. The rocker shaft 156 is mounted on top of the camshaft bearing housings 118 and, as shown most clearly in FIG. 4, also on top of the pump sleeves 124. The rocker shaft 156 is secured to the pump sleeves 124 by rocker shaft bolts 158.

The rocker shaft 156 defines a rocker shaft or rocker arm axis R, which is parallel to the camshaft axis A. A plurality of rocker arms 160*a*, 160*b*, shown only in FIG. 3, are mounted on the rocker shaft 156. Each rocker arm 160*a*, 160*b* is pivotable around the rocker shaft axis R. Two rocker arms 160*a*, 160*b* are provided for each cylinder of the engine. For each cylinder, an inlet rocker arm 160*a* actuates two associated inlet valves 116*a*, and an outlet rocker arm 160*b* actuates two associated outlet valves 116*b*.

As shown in FIG. 3, the fuel pumps 110 are aligned with the gaps between adjacent cylinders of the engine (i.e. between the inlet rocker arm 160*a* associated with one cylinder, and the outlet rocker arm 160*b* associated with an adjacent cylinder). In this way, the high-pressure fuel lines 114 are not impeded by the fuel injectors 112 or by the connections to the fuel injectors 112.

Figure 1:
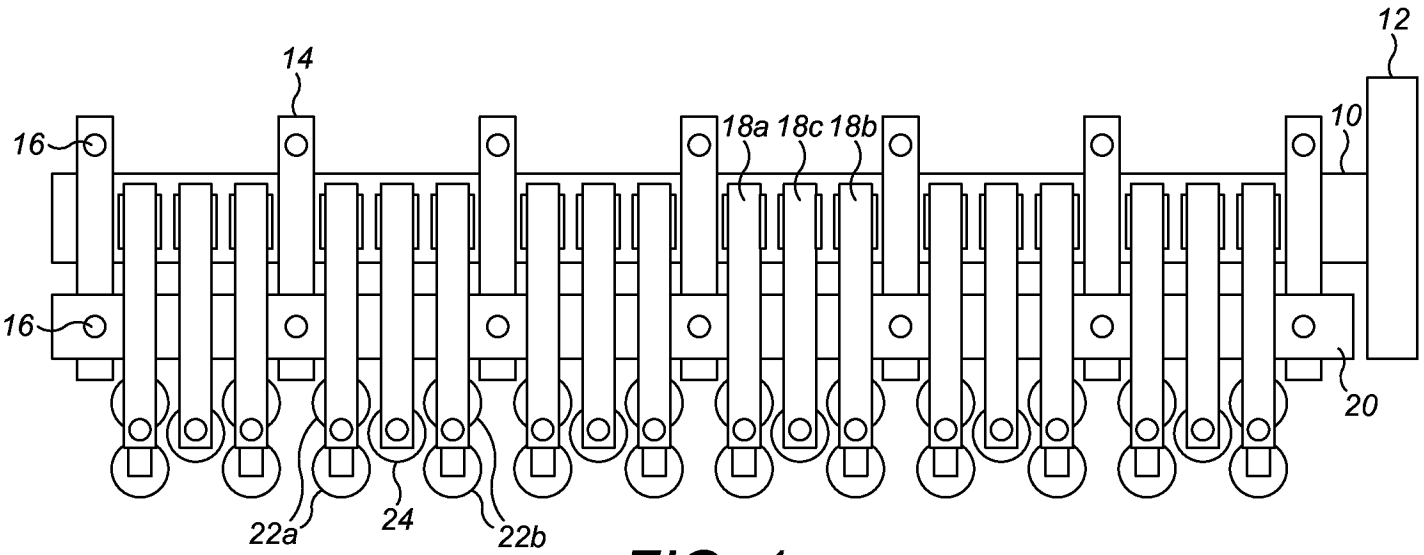
FIG. 1 (Prior Art)
FIGS. 1 and 2 of the accompanying drawings, which have already been referred to above, are plan views of, respectively, a first known fuel injection system and a second known fuel injection system for an overhead camshaft internal combustion engine.
Figure 2:
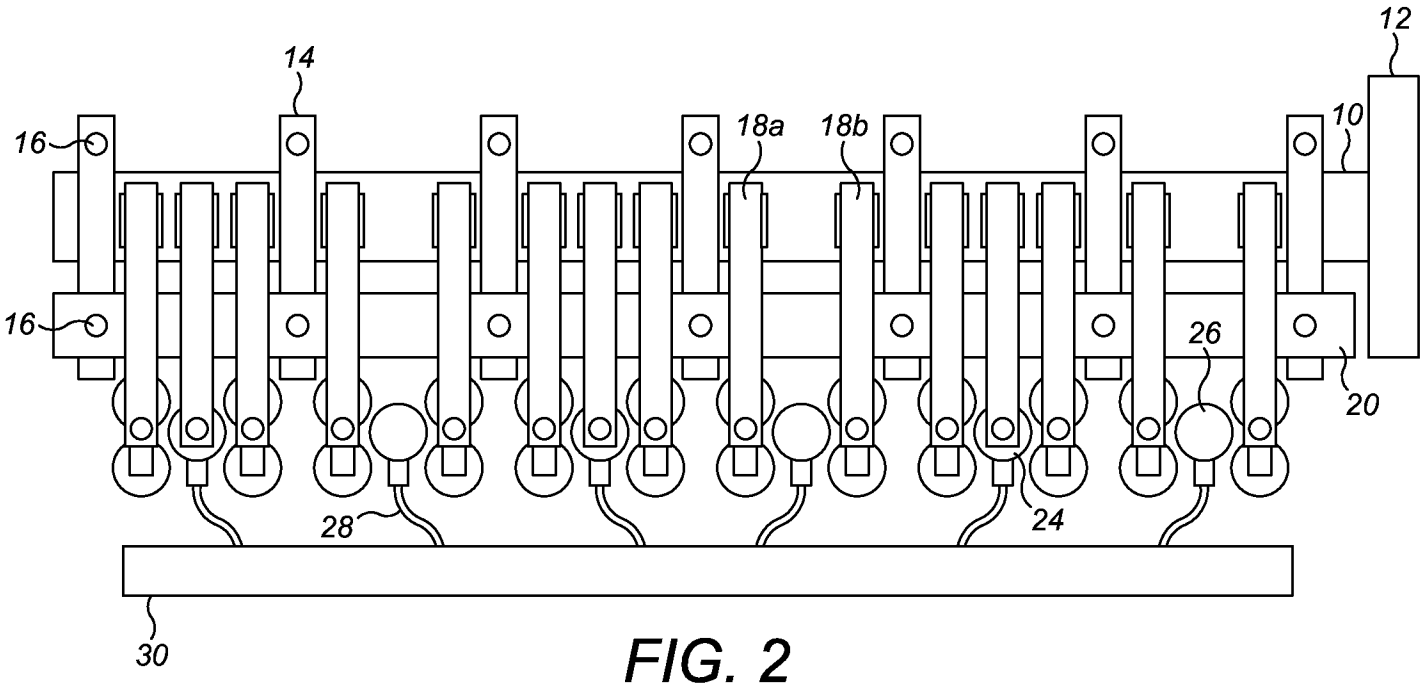
FIG. 2 (Prior Art)

To accommodate the fuel pumps 110, the bearing housings 118 are unequally spaced along the camshaft 106. So, rather than all of the bearing housings 118 being aligned with the gaps between the engine cylinders, as in the prior art arrangements of FIGS. 1 and 2, in the embodiment of FIG. 3 some of the bearing housings 118 are aligned with the centre of a cylinder (i.e. positioned between the inlet rocker arm 160*a* and the outlet rocker arm 160*b* of the same cylinder).

Specifically, in the FIG. 3 example, seven bearing housings 118 are provided. One bearing housing 118*a* is positioned at each end of the cylinder head assembly. One further bearing housing 118*b* is positioned between the first and second cylinders (numbered from the left-hand end of FIG. 3). The remaining four bearing housings 118*c* are aligned with the centres of cylinders 3, 4, 5 and 6, respectively. One of the two fuel pumps 110 is positioned between cylinders 2 and 3, and the second fuel pump 110 is positioned between cylinders 5 and 6.

Referring back to FIG. 4, each pump 110 is mounted between the rocker shaft axis R and the cylinder head block 102. The axis P of each pump is therefore disposed intermediate the rocker shaft axis R and the cylinder head block 102, and extends through the space between the rocker shaft 156 and the mounting surface 104 of the cylinder head block 102.

This arrangement of fuel pumps 110 and bearing housings 118 is particularly compact, and allows the fuel pumps 110 to be accommodated within the cylinder head assembly 100. In use, the cylinder head assembly 100 is covered by a rocker cover (not shown), which helps to damp or attenuate noise and vibration from the pumps. Advantageously, the common rail 115 may also be accommodated within the rocker cover, such that all of the high-pressure components of the fuel injection system are confined within the rocker cover. Also, because the pumps 110 are accommodated so close to the fuel injectors 112, the length of the high-pressure fuel lines 114, 145 can be minimised.

Furthermore, as will be appreciated from FIG. 4, by arranging the pumps 110 so that the pump axes P extend laterally with respect to the cylinder head assembly, and so that the pumps 110 are mounted beneath the rocker arm axis R, the pumps 110 lie close to the cylinder head block and therefore benefit from the cooling system typically provided in the cylinder head block and the engine block. Similarly, it can be seen that the pumps 110 are arranged in a location where the pump drive mechanism can be readily lubricated, taking advantage of the lubrication system that serves to lubricate the camshaft 106 and the rocker arms 160*a*, 160*b*.

Because the pumps 110 are driven directly by the pump cams 130 on the camshaft 106, it is not necessary to provide rocker arms or other mechanisms to drive the pumps 110. Advantageously, with this arrangement, side loads on the pump mechanisms can be avoided, and the cost and complexity of the system is reduced, and the return springs 140 of the pumps 110 can be of relatively low force. Furthermore, the absence of rocker arms for the pumps 110 means that more space is available for the inlet and exhaust rocker arms 160*a*, 160*b* and for other cylinder head assembly components.

Figure 5:
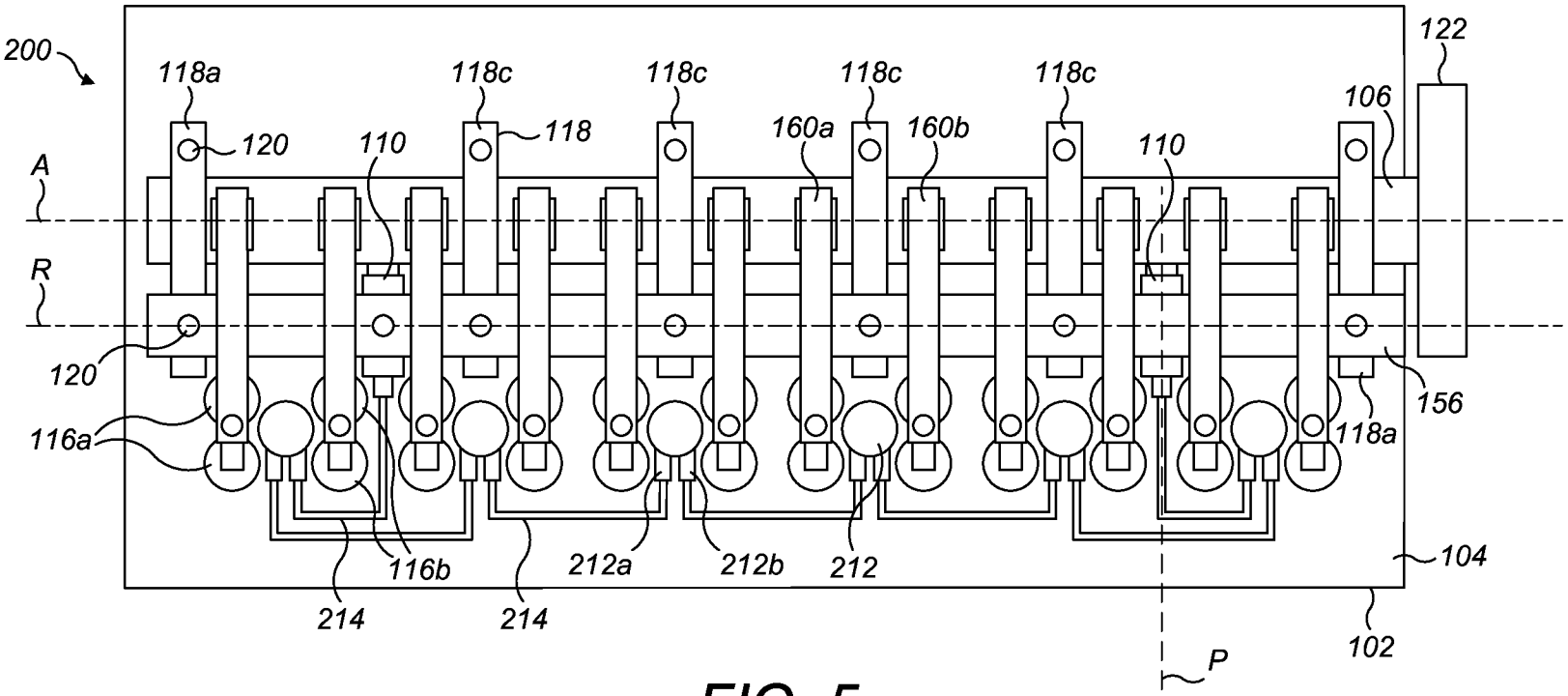
FIG. 5 is a schematic plan view of a cylinder head assembly in a second embodiment of an engine according to the present invention.

An alternative arrangement of the invention is shown in FIG. 5, which is a schematic plan view corresponding to that shown in FIG. 3. Like reference numerals are used for like parts, and only the differences between the embodiments of FIG. 5 and FIG. 3 will be described below.

In the FIG. 5 arrangement, no common rail is provided. Instead, each of the fuel injectors 212 has an inlet 212*a* and an outlet 212*b* for high-pressure fuel. Each of the pumps 110 is connected by a high-pressure fuel line 214 to the inlet 212*a* of a respective injector 212, so that, in this example, two of the injectors 212 (i.e. those associated with cylinders 1 and 6) receive high-pressure fuel directly from a fuel pump 110. The outlet 212*b* of each of these injectors 212 is connected to the inlet 212*a* of an adjacent injector 212, except that the outlets 212*b* of the two central injectors (associated with cylinders 3 and 4) are interconnected. Therefore the injectors 212 and the fuel pumps 110 are connected together in series in a "daisy chain" configuration, and an accumulator volume for fuel is provided by the interconnected volumes of the fuel lines 214 and the injectors 212.

Advantageously, the injectors 212 may include internal accumulator volumes for fuel (not shown), for example at the top of each injector 212. With the arrangement of the invention, it is not necessary to integrate fuel pump components into the injectors 212 and therefore a relatively large internal accumulator volume can be accommodated within each injector 212.

In the cylinder head assembly 200 of FIG. 5, two fuel pumps 110 are provided in the same configuration as shown in FIG. 4. However, in the FIG. 5 arrangement, one of the pumps 110 is positioned between the first and second cylinders, and the second pump 110 is positioned between the fifth and sixth cylinders. Six bearing housings 118 are provided in this case: two bearing housings 118*a* are positioned at the ends of the camshaft 106, and the remaining four bearing housings 118*c* are aligned with cylinders 2, 3, 4 and 5 respectively. So, in the FIG. 5 arrangement, none of the bearing housings are aligned with the gaps between adjacent engine cylinders, although the spacing of the bearing housings 118 is again unequal along the length of the camshaft 106.

It will be understood that the arrangements illustrated in FIGS. 3 to 5 are simply examples of the configurations that are possible in the present invention. Indeed, one important advantage of arranging the fuel pumps so that they extend laterally with respect to the cylinder head assembly is that this arrangement lends itself to multiple configurations, allowing flexibility in the design of the engine, and allowing the invention to be employed across a range of existing engine designs with minimal modification.

For example, the number of fuel pumps can be increased or decreased, so that the total pumping capacity can be matched to the requirements of the engine. In the illustrated examples, two fuel pumps are provided, but only one fuel pump may be sufficient in some applications. In other applications, more than two fuel pumps may be used.

Also, the number of camshaft bearings, and their spacing along the shaft, can be varied to accommodate the pumps in the desired locations. As will be appreciated, the arrangement of the camshaft bearings, and the strength of the camshaft, the bearings, and the bearing housings can be selected so as to ensure that the loads acting on the camshaft are within acceptable limits for safety and durability.

In the illustrated embodiments of the invention, the fuel pumps are positioned in the gaps between two adjacent engine cylinders. Advantageously, this arrangement is space-efficient because it avoids the need for the camshaft to be lengthened to accommodate the pump cams. It is also possible, however, to position one or more fuel pumps close to either or both ends of the camshaft, at one or both ends of the row of cylinders. For example, a fuel pump could be located between the end cylinder and the timing wheel on the camshaft.

In the above-described embodiments, the mating surface of the cylinder head block, which mates with the engine block, is parallel to the upper mounting surface of the cylinder head block, and the pump axis is also parallel to the mating surface. However, it will be appreciated that the mating surface and the mounting surface may not be parallel in some applications, and that the pump axis may not be parallel to one or both of these surfaces. The benefit of the invention can be achieved when the pump axis extends generally laterally or transversely with respect to the cylinder head assembly, even if the pump axis forms a non-zero angle with the mounting surface of the cylinder head block. Expressed in another way, the pump axis preferably extends away from the camshaft and between the rocker shaft and the cylinder head block.

It will be appreciated that aspects of the present invention can find application even in engines in which no rocker arms are present, such as when the gas valves are driven directly by the camshaft. Also, in engines with more than one overhead camshaft, all of the fuel pumps may be driven from one of the camshafts, or more than one of the camshafts may be used to drive respective fuel pumps.

Further modifications and variations not explicitly discussed above can also be made without departing from the scope of the invention as defined in the appended claims.

The invention claimed is:

1. An overhead-camshaft internal combustion engine having a cylinder head assembly including a cylinder head block; the engine comprising:

a camshaft mounted longitudinally with respect to the cylinder head assembly, the camshaft being rotatable about a camshaft axis and having a plurality of inlet and exhaust cams for actuating associated inlet and exhaust valves of the engine;

at least one fuel pump comprising a unit pump assembly driven directly by a respective pump cam provided on the camshaft, the unit pump assembly being elongate to define a pump axis; and a plurality of rocker arms driven by the inlet and exhaust cams and arranged to actuate the inlet and exhaust valves, wherein each rocker arm is pivotable about a rocker arm axis which is substantially parallel to the camshaft axis;

characterised in that the cylinder head block defines a mounting surface and, the or each unit pump assembly is mounted in a sleeve fixed onto said mounting surface, and wherein the or each rocker arm is mounted on a rocker shaft mounted on the sleeve so that the or each unit pump assembly is mounted between the rocker arm axis and the cylinder head block.

2. The engine according to claim 1, wherein the or each unit pump assembly is mounted such that its respective pump axis is substantially perpendicular to the camshaft axis and extends laterally with respect to the cylinder head assembly.

3. The engine according to claim 1, wherein the or each pump axis is disposed intermediate the rocker arm axis and the cylinder head block.

4. The engine according to claim 1, wherein the cylinder head block comprises a mating surface for mating with an engine block of the engine, and wherein the or each unit pump assembly is mounted such that its respective pump axis is substantially parallel to the mating surface.

5. The engine according to claim 1, wherein the engine comprises a plurality of engine cylinders and a plurality of bearings for supporting the camshaft; and wherein the or each unit pump assembly is aligned with a gap between two adjacent cylinders.

6. The engine according to claim 5, wherein at least one of the bearings is aligned centrally with respect to a respective one of the cylinders.

7. The engine according to claim 5, wherein at least one of the bearings is aligned with the gap between two adjacent cylinders.

8. The engine according to claim 5, wherein the bearings are unequally spaced along a length of the camshaft.

9. The engine according to claim 1, wherein the cylinder head block includes one or more bores for receiving one or more respective fuel injectors.

10. The engine according to claim 1, wherein the or each unit pump assembly is connected to a high-pressure common fuel rail.

11. The engine according to claim 10, wherein the common rail is mounted longitudinally with respect to the cylinder head assembly.

12. The engine according to claim 1, wherein the or each unit pump assembly is connected directly to an associated fuel injector.

13. The engine according to claim 12, comprising a plurality of fuel injectors, and wherein each fuel injector is connected directly to at least one other fuel injector.

14. The engine according to claim 13, wherein the fuel injectors and the or each fuel pump are connected together in series.

* * * * *